US011423810B2

(12) United States Patent
He et al.

(10) Patent No.: US 11,423,810 B2
(45) Date of Patent: Aug. 23, 2022

(54) FLEXIBLE DISPLAY DEVICE

(71) Applicant: WUHAN CHINA STAR OPTOELECTRONICS SEMICONDUCTOR DISPLAY TECHNOLOGY CO., LTD., Hubei (CN)

(72) Inventors: Ruiting He, Hubei (CN); Xiaokang Li, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 129 days.

(21) Appl. No.: 16/975,207

(22) PCT Filed: Jun. 23, 2020

(86) PCT No.: PCT/CN2020/097615
§ 371 (c)(1),
(2) Date: Aug. 24, 2020

(87) PCT Pub. No.: WO2021/227207
PCT Pub. Date: Nov. 18, 2021

(65) Prior Publication Data

US 2021/0358344 A1 Nov. 18, 2021

(30) Foreign Application Priority Data

May 15, 2020 (CN) ..... 202010414359.9

(51) Int. Cl.
*G09F 9/30* (2006.01)

(52) U.S. Cl.
CPC ..... *G09F 9/301* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,711,566 | B2 * | 4/2014 | O'Brien | G06F 1/1624 361/724 |
| 9,678,539 | B2 * | 6/2017 | Hayk | G06F 1/1624 |
| 9,772,657 | B2 * | 9/2017 | Takayanagi | G06F 1/1652 |
| 9,823,697 | B2 * | 11/2017 | Hsu | G06F 1/1624 |
| 10,111,346 | B2 * | 10/2018 | Seo | G06F 1/1643 |
| 10,152,086 | B2 * | 12/2018 | Choi | G09F 9/301 |
| 10,194,543 | B2 * | 1/2019 | Seo | G06F 1/1626 |
| 10,321,583 | B2 * | 6/2019 | Seo | G06F 1/1601 |

(Continued)

FOREIGN PATENT DOCUMENTS

| | | |
|---|---|---|
| CN | 104461127 A | 3/2015 |
| CN | 105609523 A | 5/2016 |

(Continued)

*Primary Examiner* — Lisa Lea-Edmonds
(74) *Attorney, Agent, or Firm* — Mark M. Friedman

(57) ABSTRACT

A flexible display device is provided. The flexible display device includes a display body, a scroll box disposed on a side of the display body, and a flexible display screen, wherein an end of the flexible screen is connected to the scroll box, and a middle portion of the flexible screen is fixed on the display body. The flexible display screen is configured to be rolled up around the scroll box and be unrolled.

9 Claims, 2 Drawing Sheets

(56) References Cited

U.S. PATENT DOCUMENTS

| | | | | |
|---|---|---|---|---|
| 10,321,584 | B2 | 6/2019 | Choi et al. | |
| 10,860,063 | B2 * | 12/2020 | Han | G06F 1/1652 |
| 10,881,009 | B2 * | 12/2020 | Jiang | G06F 1/1624 |
| 11,170,671 | B1 * | 11/2021 | Han | G06F 1/1601 |
| 11,194,363 | B2 * | 12/2021 | Kim | G06F 1/1637 |
| 11,226,655 | B2 * | 1/2022 | Shim | G06F 1/1643 |
| 11,240,923 | B2 * | 2/2022 | Wang | H05K 5/0017 |
| 11,259,427 | B2 * | 2/2022 | Feng | H05K 5/0017 |
| 2013/0038584 | A1 | 2/2013 | Burgin et al. | |
| 2017/0325343 | A1 * | 11/2017 | Seo | G03B 21/58 |
| 2021/0375165 | A1 * | 12/2021 | Feng | G06F 1/1652 |

FOREIGN PATENT DOCUMENTS

| | | | |
|---|---|---|---|
| CN | 107895541 | A | 4/2018 |
| CN | 108040154 | A | 5/2018 |
| CN | 109979329 | A | 7/2019 |
| CN | 110047384 | A | 7/2019 |
| CN | 111128013 | A | 5/2020 |
| CN | 210467103 | U | 5/2020 |
| EP | 2557556 | A2 | 2/2013 |

* cited by examiner

FLEXIBLE DISPLAY DEVICE

CROSS REFERENCE TO RELATED APPLICATIONS

The present application claims the priority to Chinese Patent Application No. 202010414359.9, entitled "FLEXIBLE DISPLAY DEVICE", which was filed in Chinese Patent Office on May 15, 2020, the whole contents of which are incorporated herein by reference.

FIELD OF INVENTION

The present disclosure relates to the field of display technologies, and more particularly, to a flexible display device.

BACKGROUND OF INVENTION

Active matrix organic light emitting diodes (AMOLED) are expected to replace liquid crystals to become the mainstream choice of next generation displays due to their high contrast, wide viewing angles, fast response times and flexibility.

Currently, a rollable flexible panel can be produced by the major manufacturers, and the roll diameter ranges from 5 mm to 10 mm. However, since driving motherboards, batteries and other accessories have not achieved a breakthrough in rolling technology, the applications of rollable display panels are severely restricted. It is estimated by industry professionals that the rollable displays will not be widely used until 2023.

As the number of turns of rollable screen increases, the differences in rolled lengths between the laminated film layers of the display become larger, and partial peeling occurs when the rolled range does not reach 100% of the length of the entire panel. Please refer to FIG. 1. FIG. 1 is a structural schematic diagram of the existing flexible display device partially peeled off when rolled. The flexible display device includes an upper substrate 1, a lower substrate 2, and a scroll 3, wherein the scroll 3 is connected to the lower substrate 2, the upper substrate 1 and the lower substrate 2 are configured to be rolled up around the scroll and be unroll rolled.

Therefore, it is necessary to provide a new flexible display device to solve the problems of the prior art.

SUMMARY OF INVENTION

Technical Problems

An object of the present disclosure is to provide a flexible display device, which can solve the problem of partial peeling when the flexible display device is rolled up in the prior art.

Technical Solutions

In order to achieve the above object, the present disclosure provides a flexible display device, including: a display body; a scroll box disposed on a side of the display body; and a flexible display screen, wherein an end of the flexible screen is connected to the scroll box, and a middle portion of the flexible screen is fixed on the display body; wherein the flexible display screen is configured to be rolled up and be unrolled around the scroll box.

Further, in other embodiments, wherein the scroll box includes: a case; at least one movable component movably assembled in the case; a plurality of bearings, wherein a part of the bearings are fixed in the case, and a part of the bearings are fixed on the movable component; at least one fixed scroll, wherein each of the fixed scroll is fixed in the case through the corresponding bearing; at least one movable scroll, wherein each of the movable scroll is fixed on the corresponding movable component through the corresponding bearing, and each of the movable scroll corresponds to one of the fixed scroll, and in response to the rotation of the fixed scroll, a rotational direction of the movable scroll is opposite a rotational direction of the fixed scroll; wherein the flexible display screen is rolled on the fixed scroll and the movable scroll; wherein when the flexible display screen is unrolled, the movable component is moved toward a side away from the display body, and when the flexible display screen is rolled up, the movable component is moved toward a side close to the display body.

Further, in other embodiments, wherein the moveable scroll and the fixed scroll are disposed in parallel to each other.

Further, in other embodiments, wherein the moveable scroll and the fixed scroll are disposed alternately.

Further, in other embodiments, wherein when a number of the fixed scrolls is two or more, a first gap is defined by the adjacent two fixed scrolls, and the first gap is less than twice of a diameter of the movable scroll and is greater than the diameter of the movable scroll; when a number of the movable scrolls is two or more, a second gap is defined by the adjacent two movable scrolls, and the second gap is less than twice of a diameter of the fixed scroll and is greater than the diameter of the fixed scroll.

Further, in other embodiments, wherein when the flexible display screen is unrolled to a longest state, the movable scrolls are moved to a position flush with the fixed scrolls, one of the movable scrolls is arranged between the adjacent two fixed scrolls, and one of the fixed scrolls is arranged between the adjacent two movable scrolls.

Further, in other embodiments, wherein a number of turns of the flexible display screen rolled on the fixed scroll is equal to a number of the flexible display screen rolled on the movable scroll. In this way, the problem of partial peeling when the flexible display device is rolled up can be solved.

Further, in other embodiments, wherein the movable component comprises a track, and the moveable scroll is configured to move in the track.

Further, in other embodiments, wherein the moveable component comprises a control member, the control member is configured to control the fixed scroll to rotate counterclockwise or to rotate clockwise; when the flexible display screen is rolled up, the control member controls the fixed scroll to rotate counterclockwise, then the corresponding movable scroll is rotated clockwise and is moved from an end away from the display body to an end close to the display body; when the flexible display screen is unrolled, the control member controls the fixed scroll to rotate clockwise, then the corresponding movable scroll is rotated clockwise and is moved from an end away from the display body to an end close to the display body.

Further, in other embodiments, wherein a number of the scroll boxes is two, the two scroll boxes are respectively disposed on two side of the display body. In this way, the unrolled area of the flexible display device can be further increased, and the use of the large screen mobile smart phone can be realized.

Further, in other embodiments, wherein a signal motherboard, a signal transmitting module, a storage module, and a battery are disposed in the display body.

Beneficial Effect

In comparison with the prior art, the present disclosure has the following beneficial effects: the present disclosure provides a flexible display device, and the plurality of scrolls which automatically rotate and move are disposed in the scroll box, thereby realizing the function of rolling and unrolling the screen. In this way, the problem of partial peeling when the flexible display device is rolled up can be alleviated, and the consumer experience of the use of large screen mobile smart phones can be realized. The shortcomings of the existing mobile screen, such as a small screen and a large size, are improved, and the comfort of consumers in using the smart phones is improved.

DESCRIPTION OF DRAWINGS

In order to make the above content of the present disclosure more comprehensible, the preferred embodiments are described as follows in detail with the accompanying drawings.

DETAILED DESCRIPTION OF PREFERRED EMBODIMENTS

The technical solutions in the embodiments of the present application will be clearly and completely described below in conjunction with the drawings in the embodiments of the present application. Obviously, the described embodiments are only a part of the embodiments of the present application, rather than all the embodiments. Based on the embodiments in this application, all other embodiments obtained by those skilled in the art without creative work fall within the protection scope of this application.

Embodiment 1

Figure 1:
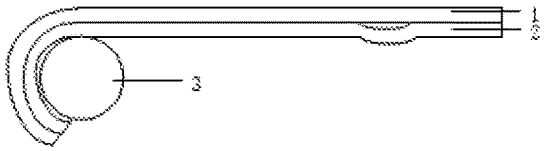
FIG. 1 is a structural schematic diagram of the existing flexible display device partially peeled off when rolled.
Figure 2:
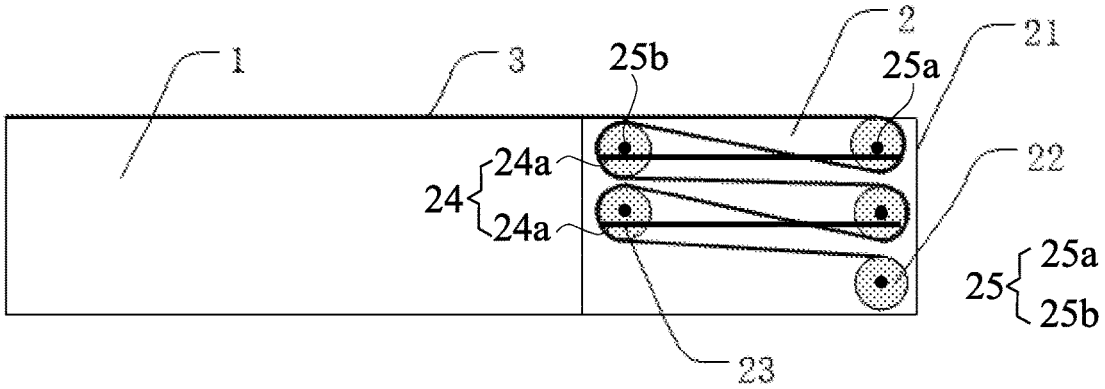
FIG. 2 is a structural schematic diagram of a flexible display device provided by Embodiment 1 of the present disclosure.

The embodiment of the present disclosure provides a flexible display device. Please refer to FIG. 2. FIG. 2 is a structural schematic diagram of a flexible display device provided by the embodiment of the present disclosure. The flexible display 2 includes a display body 1, a scroll box 2, and a flexible display screen 3.

A motherboard, a signal transmitting module, a storage module, and a battery are disposed in the display body 1.

The scroll box 2 is disposed on a side of the display body 1, and the scroll box 2 includes a case 21, a movable component 24, bearings 25, fixed scrolls 22, and movable scrolls 23. An end of the flexible display screen 3 is connected to the scroll box 2, and a middle portion of the flexible screen 3 is fixed on the display body 1, such that the flexible display screen 3 can be rolled up and be unrolled around the scroll box 2.

The movable components 24 are movably assembled in the case 21. A part of the bearings 25*a* are fixed in the case 21, and a part of the bearings 25*b* are fixed on the movable component 24. Each of the fixed scrolls 22 is fixed in the case 21 through the corresponding bearing 25*a*. Each of the movable scrolls 23 is fixed on the corresponding movable component 24 through the corresponding bearing 25*b*.

Each of the movable scrolls 23 corresponds to one of the fixed scrolls 22, and in response to the rotation of the fixed scroll 22, a rotational direction of the movable scroll 23 is opposite a rotational direction of the fixed scroll 22.

The flexible display screen 3 is rolled on the fixed scroll 22 and the movable scroll 23. When the flexible display screen 3 is unrolled, the movable component is moved toward a side away from the display body 1, and when the flexible display screen 3 is rolled up, the movable component is moved toward a side close to the display body 1. The movable component 24 includes a track 24*a*, and the moveable scroll 23 is configured to move in the track 24*a*.

Figure 3:
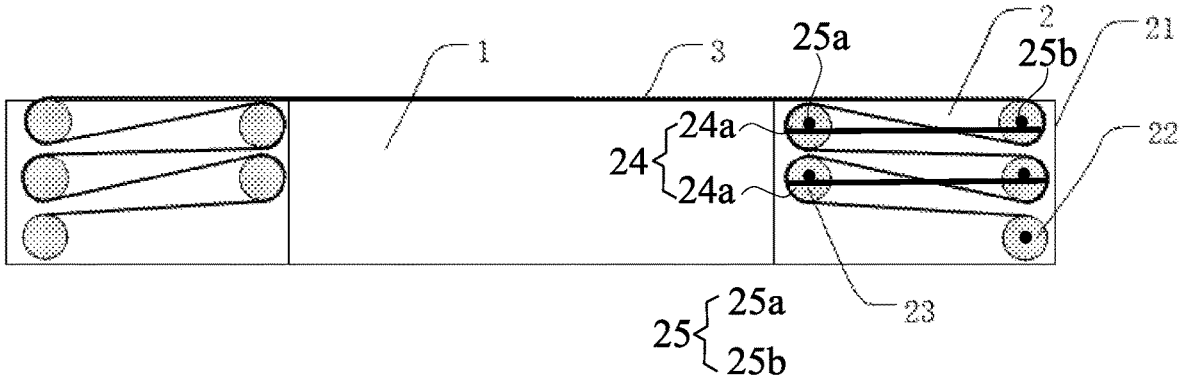
FIG. 3 is a structural schematic diagram of the flexible display device provided by Embodiment 1 of the present disclosure when the number of the scroll boxes is two.

In this embodiment, the number of the scroll box 2 is one, and the scroll box 2 is disposed on a side of the display body 1. In other embodiments, the number of the scroll boxes 2 may be two. Please refer to FIG. 3. FIG. 3 is a structural schematic diagram of the flexible display device provided by the embodiment of the present disclosure when the number of the scroll boxes is two. The two scroll boxes 2 are respectively disposed on two sides of the display body 1. In this way, the unrolled area of the flexible display device can be further increased, and the use of the large screen mobile smart phone can be realized.

In this embodiment, the moveable scroll 23 and the fixed scroll 22 are disposed in parallel to each other.

The number of turns of the flexible display screen 3 rolled on the fixed scroll 22 is equal to the number of the flexible display screen 3 rolled on the movable scroll 23. In this way, the problem of partial peeling when the flexible display device is rolled up can be solved.

The moveable component 24 includes a control member, the control member is configured to control the fixed scroll 22 to rotate counterclockwise or to rotate clockwise.

When the flexible display screen 3 is rolled up, and the control member controls the fixed scroll 22 to rotate counterclockwise, then the corresponding movable scroll 23 is rotated clockwise and is moved form an end away from the display body 1 to an end close to the display body 1.

Figure 4:
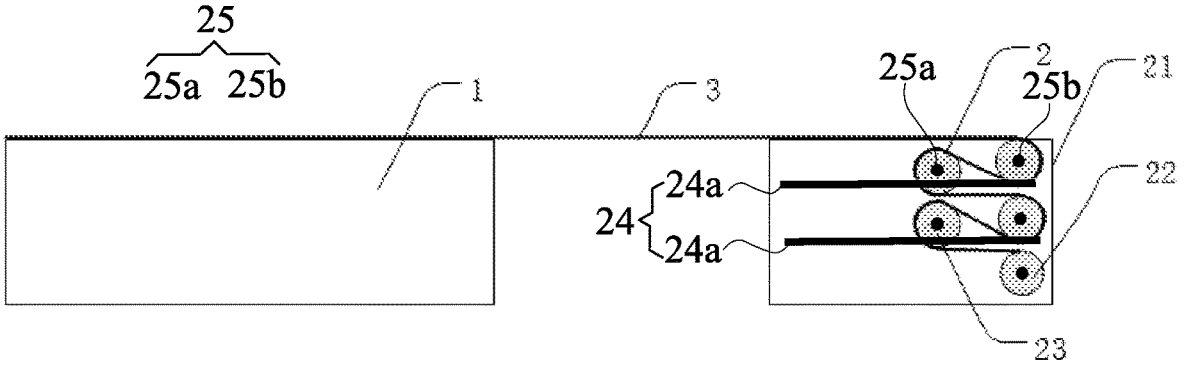
FIG. 4 is a structural schematic diagram of the flexible display device provided by Embodiment 1 of the present disclosure when the flexible display device is unrolled.

When the flexible display screen 3 is unrolled, and the control member controls the fixed scroll 22 to rotate counterclockwise, then the corresponding movable scroll 23 is rotated clockwise and is moved from the end away from the display body 1 to the end close to the display body 1. Please refer to FIG. 4. FIG. 4 is a structural schematic diagram of the flexible display device provided by the embodiment of the present disclosure when the flexible display device is unrolled.

Embodiment 2

Figure 5:
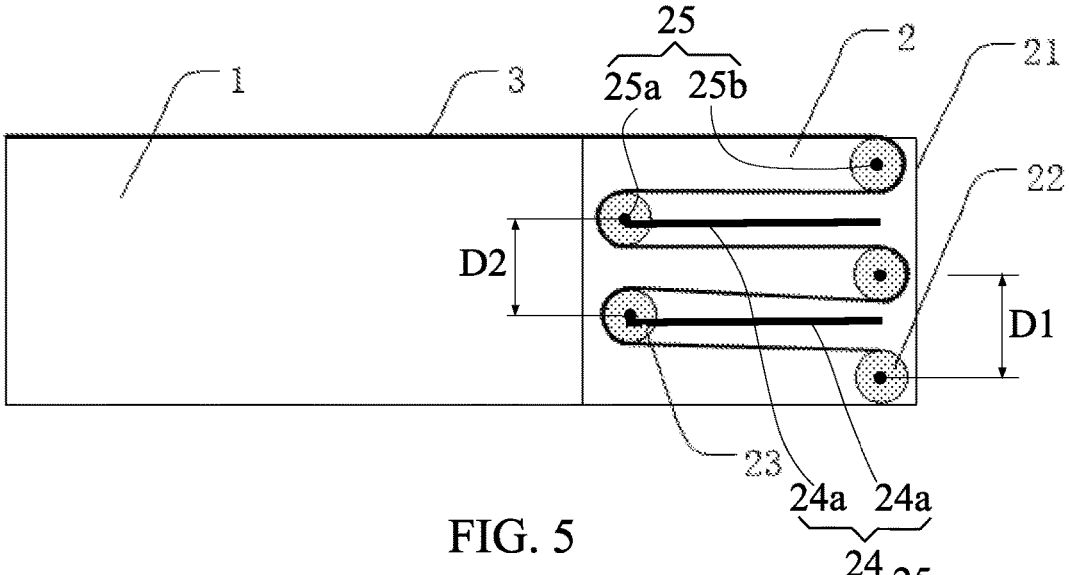
FIG. 5 is a structural schematic diagram of a flexible display device provided by Embodiment 2 of the present disclosure.

The flexible display device in this embodiment, the flexible display device also includes fixed scrolls 22 and movable scrolls 23, and the structure is the same as the corresponding structure in Embodiment 1. Refer to the corresponding description in Embodiment 1, for the structure, which is not be repeated here. The difference between the two embodiments is that the movable scrolls 23 and the fixed scrolls 22 are disposed alternately. Please refer to FIG. 5. FIG. 5 is a structural schematic diagram of a flexible display device provided by the embodiment of the present disclosure.

A first gap D1 is defined by the adjacent two fixed scrolls 22, and the first gap D1 is less than twice of a diameter of the movable scroll 23 and is greater than the diameter of the movable scroll 23. A second gap D2 is defined by the adjacent two movable scrolls 23, and the second gap D2 is less than twice of a diameter of the fixed scroll 22 and is greater than the diameter of the fixed scroll 22.

Figure 6:
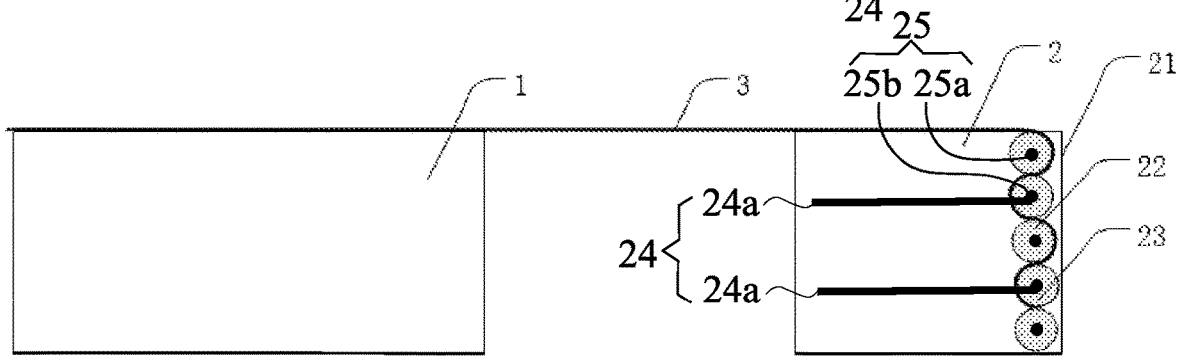
FIG. 6 is a structural schematic diagram of the flexible display device provided by Embodiment 2 of the present disclosure when the flexible display device is unrolled.

Please refer to FIG. 6, FIG. 6 is a structural schematic diagram of the flexible display device provided by the embodiment of the present disclosure when the flexible display device is unrolled. When the flexible display screen 3 is unrolled to a longest state, the movable scrolls 23 are moved to a position flush with the fixed scrolls 22, one of the movable scrolls 23 is arranged between the adjacent two fixed scrolls 22, and one of the fixed scrolls 22 is arranged between the adjacent two movable scrolls 23.

The unrolled area of the flexible display device can be further increased, and the use of the large screen mobile smart phone can be realized through this embodiment.

The present disclosure has the following beneficial effects: the present disclosure provides a flexible display device, and the plurality of scrolls which automatically rotate and move are disposed in the scroll box 2, thereby realizing the function of rolling and unrolling the screen. In this way, the problem of partial peeling when the flexible display device is rolled up can be alleviated, and the consumer experience of the use of large screen mobile smart phone can be realized. The shortcomings of the existing mobile screen, such as a small screen and a large size, are improved, and the comfort of consumers in using the smart phones is improved.

In the above embodiments, the description of each embodiment has its own emphasis. For parts that are not described in detail in an embodiment, reference may be made to related descriptions of other embodiments.

The flexible display device provided by the embodiment of the disclosure is described in detail above. Specific examples are used in this article to illustrate the principles and implementation of this application. The description of the above embodiments is only used to help understand the technical solutions and core ideas of this application. The person skilled in the art should understand that they can still modify the technical solutions described in the foregoing embodiments, or equivalently replace some of the technical features. However, these modifications or replacements do not cause the essence of the corresponding technical solutions to deviate from the scope of the technical solutions of the embodiments of the present application.

What is claimed is:

1. A flexible display device, comprising:

a display body;

a scroll box disposed on a side of the display body; and a flexible display screen, wherein an end of the flexible screen is connected to the scroll box, and a middle portion of the flexible screen is fixed on the display body;

wherein the flexible display screen is configured to be rolled up and be unrolled around the scroll box;

wherein the scroll box comprises:

a case;

at least one movable component movably assembled in the case;

a plurality of bearings, wherein a part of the bearings are fixed in the case, and a part of the bearings are fixed on the movable component;

at least one fixed scroll, wherein each of the fixed scroll is fixed in the case through the corresponding bearing;

at least one movable scroll, wherein each of the movable scroll is fixed on the corresponding movable component through the corresponding bearing, and each of the movable scroll corresponds to one of the fixed scroll, and in response to the rotation of the fixed scroll, a rotational direction of the movable scroll is opposite a rotational direction of the fixed scroll;

wherein the flexible display screen is rolled on the fixed scroll and the movable scroll;

wherein when the flexible display screen is unrolled, the movable component is moved toward a side away from the display body, and when the flexible display screen is rolled up, the movable component is moved toward a side close to the display body.

2. The flexible display device according to claim 1, wherein the moveable scroll and the fixed scroll are disposed in parallel to each other.

3. The flexible display device according to claim 1, wherein the moveable scroll and the fixed scroll are disposed alternately.

4. The flexible display device according to claim 3, wherein when a number of the fixed scrolls is two or more, a first gap is defined by the adjacent two fixed scrolls, and the first gap is less than twice of a diameter of the movable scroll and is greater than the diameter of the movable scroll;

when a number of the movable scrolls is two or more, a second gap is defined by the adjacent two movable scrolls, and the second gap is less than twice of a diameter of the fixed scroll and is greater than the diameter of the fixed scroll.

5. The flexible display device according to claim 4, wherein when the flexible display screen is unrolled to a longest state, the movable scrolls are moved to a position flush with the fixed scrolls, one of the movable scrolls is arranged between the adjacent two fixed scrolls, and one of the fixed scrolls is arranged between the adjacent two movable scrolls.

6. The flexible display device according to claim 1, wherein a number of turns of the flexible display screen rolled on the fixed scroll is equal to a number of the flexible display screen rolled on the movable scroll.

7. The flexible display device according to claim 1, wherein the movable component comprises a track, and the moveable scroll is configured to move in the track.

8. The flexible display device according to claim 1, wherein the moveable component comprises a control member, the control member is configured to control the fixed scroll to rotate counterclockwise or to rotate clockwise;

when the flexible display screen is rolled up, the control member controls the fixed scroll to rotate counterclockwise, then the corresponding movable scroll is rotated clockwise and is moved from an end away from the display body to an end close to the display body;

when the flexible display screen is unrolled, the control member controls the fixed scroll to rotate counterclockwise, then the corresponding movable scroll is rotated clockwise and is moved from an end away from the display body to an end close to the display body.

9. The flexible display device according to claim 1, wherein a number of the scroll boxes is two, the two scroll boxes are respectively disposed on two side of the display body.

* * * * *